United States Patent [19]

Edwards et al.

[11] Patent Number: 4,583,248

[45] Date of Patent: Apr. 22, 1986

[54] INSULATED GLOVE

[76] Inventors: Joseph H. Edwards, 3455 Tree Farm La., Salt Lake City, Utah 84121; Michael Carey, 5853 Lance St., San Diego, Calif. 92120

[21] Appl. No.: 714,962

[22] Filed: Mar. 21, 1985

[51] Int. Cl.[4] ..... A41D 19/00

[52] U.S. Cl. ..... 2/164; 2/167

[58] Field of Search ..... 2/164, 167, 168, 158, 2/161 A, 159

[56] References Cited

U.S. PATENT DOCUMENTS

| | | | |
|---|---|---|---|
| 2,842,771 | 7/1958 | Foti | 2/164 X |
| 2,970,317 | 2/1961 | Winson | 2/167 |
| 3,114,915 | 12/1963 | Gross | 2/164 X |
| 3,267,486 | 8/1966 | Madnick | 2/164 |
| 3,916,448 | 11/1975 | Hamel | 2/164 |
| 4,430,759 | 2/1984 | Jackrel | 2/167 |
| 4,488,313 | 12/1984 | Delaney | 2/161 A |

FOREIGN PATENT DOCUMENTS

| | | | |
|---|---|---|---|
| 904804 | 8/1962 | United Kingdom | 2/158 |

OTHER PUBLICATIONS

L. L. Bean, Inc., advertisement, "Gore-Tex ® Winter Sports Glove", 1984.

*Primary Examiner*—Ronald Feldbaum

*Attorney, Agent, or Firm*—Trask & Britt

[57] ABSTRACT

An insulated ski glove having an outer shell formed to surround the hand is disclosed. A portion of the outer shell is fabricated from a material which is permeable to water vapor and impermeable to liquid water. The glove is lined with a material having low thermal conductivity, a portion of which is permeable to moisture.

12 Claims, 6 Drawing Figures

INSULATED GLOVE

BACKGROUND OF THE INVENTION

1. Field

This invention relates to hand gloves, specifically insulated gloves for use by the wearer in cold weather.

2. State of the Art

Hand gloves are well-known in the art. In a typical construction, a glove includes a pair of flexible, fabric sheets having the general shape and dimensions of the wearer's hand. The sheets are positioned approximately parallel and are joined to each other along their edge by stitching to define a substantially enclosed chamber. The chamber is accessed through an opening dimensioned to receive the wearer's hand. Generally, some gloves may have an elastic collar about the opening so that the opening may expand to permit the larger portion of the wearer's hand to enter the chamber. Upon the hand being substantially enclosed by the chamber, the opening contracts about the wearer's wrist so as to essentially restrict air flow from the environment into the chamber.

Some gloves further include an individual chamber or cover to receive each finger and the thumb (generally all called fingers) of the wearer's hand.

Gloves are typically used by the wearer to protect the wearer's hands from contacting contaminants. In cold weather, the wearer may also use gloves to insulate his hands from the effects of a lowered temperature environment, i.e. the gloves are used to retain the body heat, radiated or otherwise transferred from the hands, within the glove chamber proximate the hand itself, thus preventing a radical depression of the hand's temperature and the physical damage resulting therefrom.

In providing a glove with insulating characteristics, several considerations must be reviewed. First, the wearer's hands must retain a considerable amount of freedom of movement. Oftimes, the wearer is required to perform tasks outdoors requiring considerable manual dexterity; for example, in outdoor sporting activities such as skiing. Any restriction in that dexterity operates to lessen the value of the glove to the user. Dexterity usually requires enabling each of the wearer's fingers to move functionally in a manner independent of the motion of the other fingers. It follows that finger-style gloves are generally preferred over the so-called fingerless or mitten-type glove.

Also, the glove should exhibit good insulation qualities, i.e. an ability to establish a barrier having low thermal conductivity between the wearer's hand and the environment. This thermal conductivity or insulative quality is generally defined in the art as the barrier's "R" factor. The capacity of a thermal barrier to retard heat transfer is directly proportional to the amount of surface area a barrier presents to the lower temperature environment; i.e., the greater the surface area, the more extensive the heat loss. Recognizably, a fingered glove, due to the surface area of the barrier required to encase each finger, typically presents a larger heat transfer surface than a non-fingered glove. Further, owing to the high surface to volume ratio presented by each finger, considerable attention must be paid to providing an adequate thermal barrier should the glove be expected to prove adequate for any extended exposure to low temperature environments.

Oftimes the wearer is required to engage in physically strenuous outdoor activities. This exertion results in the generation of perspiration on the wearer's hands. Absent a means of withdrawing this moisture, the interior of the glove is soon saturated. Not only does this saturation produce discomfort for the wearer, but furthermore, the moisture draws heat from the wearer's hand when it evaporates, thereby lowering the wearer's hand temperature. Also, the inside of the glove may become damp through the wearer taking off the glove in a snowstorm and reinserting wet hands into the glove.

Further, the wearer must oftimes remain outdoors in rain or snow. To keep dry, the gloves must be resistant to moisture or water penetration from the environment.

Attempts in the art to satisfy effectively each of the above criteria have not met with success. Prior glove constructions have typically been able to optimize effectiveness in one criteria only by depreciating effectiveness in another criteria. For example, water resistancy has been obtained in some glove constructions by fabricating the glove from a rubber or rubber-like material having a high impermeability to water. Though these gloves proved highly resistant to exterior moisture, the moisture produced inside of the glove, i.e. by the wearer's sweat, was trapped within the glove and thereafter contributed to considerable discomfort for the wearer.

There exists a need for a glove which is wind-and water-resistant, and capable of effectively insulating the wearer's hand from heat loss, while permitting the wearer substantially undiminished manual dexterity. Furthermore, the glove should have means for absorbing moisture produced on the surface of the wearer's hand and expelling that moisture through the glove.

SUMMARY OF THE INVENTION

A glove constructed according to this invention includes an outer casing or skin constructed of two fabric panels, each having a shape corresponding approximately to that of the hand of the wearer. The two panels are held in a fixed relationship to each other, either by means of joining the two panels at their perimeters (for example by stitching or adhesives) or alternately interposing a third fabric panel between the two panels wherein the third panel is secured to the two panels along substantially opposing sides of the third panel. The panel which forms the palm side of the glove is fabricated from a material, e.g. leather, having the properties of flexibility and breathability, i.e. it is permeable to air. The panel which covers the back of the wearer's hand is fabricated from a microporous material which is water-repellant and wind-resistant on its outward facing side while having the property of being moisture-permeable on its inwardly facing side; i.e., the fabric permits moisture to pass from its inwardly facing side out through the outwardly facing surface while resisting the transmission of liquid from its outwardly facing surface through to its inwardly facing surface.

The glove is fitted with a first interior liner which is separate from the fabric skin. In a construction which substantially parallels that of the two-panel fabric skin, the liner includes two insulated panels shaped to correspond to the wearer's hand. The panels are fixedly secured to each other at their perimeters by stitching or similar joining means. One of the insulating panels is fabricated from a closed-cell foam material having a low thermal conductivity. The material typically has a low permeability to air. The other insulating panel is fabricated from a material having a low thermal conductivity while also possessing a moisture permeability. In essence, the wearer's hand is protected by an insulating liner which obtains a balance between low thermal conductivity and breathability.

A secondary insulating liner is housed within the first interior liner. This secondary liner is constructed substantially similar to the first liner; i.e., two fabric panels being joined at their perimeters. The secondary liner is fabricated from a material which is permeable to liquid water, moisture and air, while also having a low thermal conductivity.

The skin of the glove is constructed to minimize the potentiality of exterior moisture penetration while simultaneously allowing for the evaporation of moisture generated from the surface of the skin of the wearer.

The function of the liners is to provide a low thermal conductivity barrier between the wearer's hand and the environment while simultaneously absorbing and transferring moisture or liquid water from the wearer's hand outward to the skin of the glove.

DESCRIPTION OF THE ILLUSTRATED EMBODIMENTS

Figure 1:
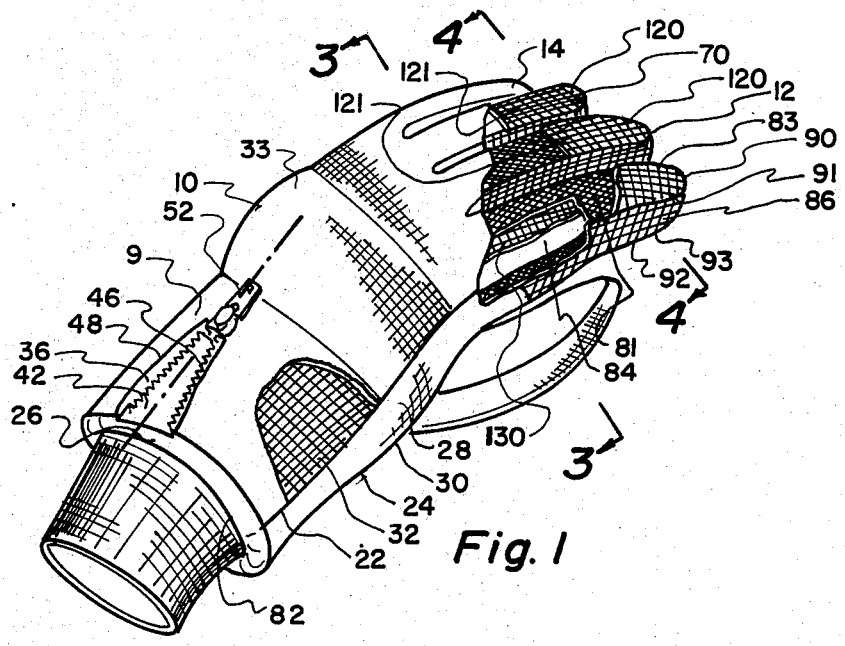
FIG. 1 is an elevational perspective view of the back portion of a fingered glove of this invention showing in cut-away section the various interior liner portions of the glove.

As shown in FIG. 1, a glove, generally 9, constructed in accordance with this invention includes a back fabric panel 10 which is shaped and dimensioned to approximate the shape and dimensions of the back portion of the intended wearer's hand. Panel 10 may include at its proximal end 12 four segregated elongate panel sections 14 dimensioned in shape in correspondence to the individual fingers of the wearer.

The back panel 10 is fabricated from a microporous fabric having an outward surface thereof which is resistant to penetration by air, wind or water. The opposing inward surface of the fabric is adapted to be permeable to moisture, thus permitting moisture proximate the inward surface to pass through the fabric while moisture or water proximate the outwardly facing surface is precluded from passing through the fabric to reach the interior of the glove. Fabrics embodying these characteristics may include nylon having a sealant film, e.g. urethane or polytetrafluroethylene (teflon), applied thereto. Such fabrics are available commercially under the trademarks Gortex and Entrant.

In a preferred embodiment, the nylon fabric includes a weave permitting the fabric to stretch in four directions. This stretching property allows the glove construction flexibility to follow the wearer's hand movements. The fabric sold under the designation Entrant includes this stretching property.

Figure 6:
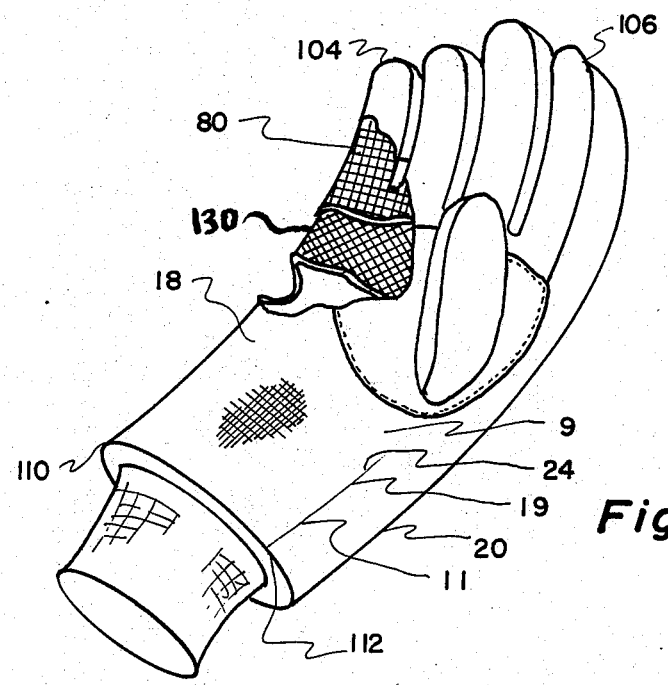
FIG. 6 is an elevational perspective view of the palm portion of a fingered glove of the invention showing in cut-away section the various interior liner portions of the glove.

As shown in FIG. 6, the glove 9 also includes a palm fabric panel 18 dimensioned and shaped to correspond to the general shape and dimensions of the wearer's palm, thumb and fingers. Panel 18 is fabricated from a fabric which is flexible while also having the ability to breathe, i.e. air and moisture may pass through the fabric. Typical fabrics for use in the palm panel 18 may include leather, wool, or similar permeable fabric. Panels 10 and 18 are joined together along their perimeters by stitching, adhesives, or an alternate fastening means known in the art.

The glove 9 may include a side panel 20 which is interposed between panels 10 and 18 over essentially the total length of the respective perimeters 22 and 24 of each panel, with exception of the distal end 26. Side panel 20 may include a series of subsectional panels 28 which are joined together to form the total panel 20. Edge 30 of side panel 20 is joined to the perimeter 24 of palm panel 18 over essentially the total perimeter of panel 18. The opposing edge 32 of side panel 20 is then joined to perimeter 22 of back panel 20 over essentially the total perimeter of that panel, the end result being a generally hand-shaped cover or skin 33 which is sealed except at its distal end 26. Side panel 20 may be fabric from either of the materials used in the fabrication of back panel 10 or palm panel 18. Alternately, side panel 20 may include a combination of subpanels 28 wherein each subpanel is fabricated from either of the materials composing the palm panel 18 or back panel 10.

Figure 2:
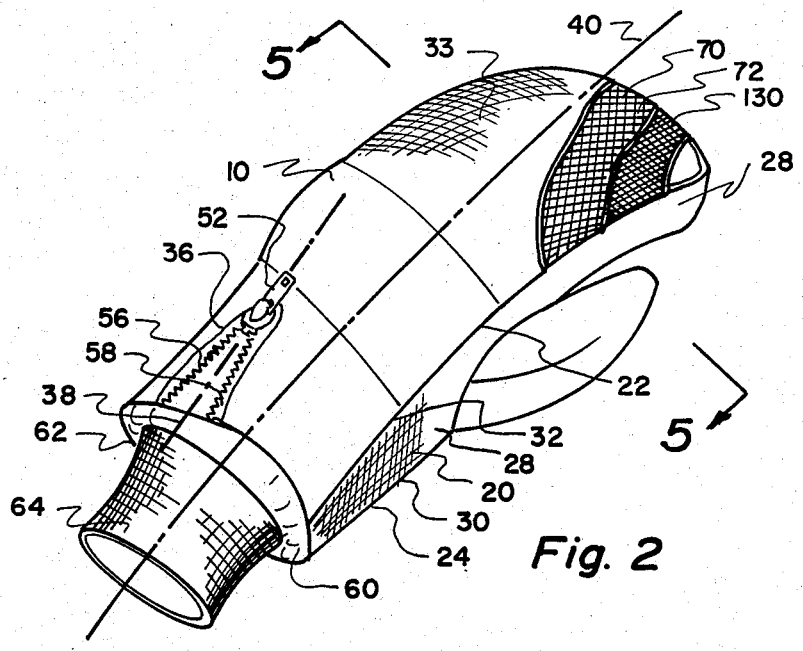
FIG. 2 is an elevational perspective view of the back portion of a mitten-style glove of this invention showing in cut-away section the liner of the glove.

The skin 33 may include a zipper 36 positioned in the back panel 10 proximate the distal end 34 of the glove 9. The zipper 36 is positioned such that its longitudinal axis 38 is substantially parallel to the longitudinal axis 40 of the back panel 10. A preferred embodiment requires an essentially triangular secondary panel 42 being positioned beneath the zipper 36. Secondary panel 42 is joined to back panel 10 along its edges 46 and 48, thereby defining an essentially continuous cover surface for the hand when the zipper is in its open position as shown in FIGS. 1 and 2. Upon the zipper tab 52 being drawn toward distal end 26 of the glove, the edges 56 and 58 of back panel 10 are drawn into close proximity, thereby constricting the circumference 60 of the distal end 26 of the glove skin.

This constricting action allows the wearer to bring the wrist portion, generally 62, of the glove into close and sealing contact with the wearer's wrist. Secondary panel 42 is folded inwardly against the wrist portion of the wearer's hand during this constricting action. The glove 9 may also include an elasticized cuff 64. The cuff 64 is of a generally tubular construction known in the art. The cuff is joined to the circumference 60 of the distal end 26 of the skin along the full length of that circumference.

The glove 9 may include a fabic insulative liner 70. Liner 70 includes a liner back panel 72 which in dimensions and shape approximates the back panel 10. In one embodiment, liner back panel 72 is fabricated from a fibrous material having the characteristics of flexibility and low thermal conductivity while also being breathable, i.e. permeable to air and moisture. A preferred embodiment utilizes a material composed of approximately 65% olefin fibers (polypropylene) and apppoximately 35% polyester fibers. This material is commercially available under the trade designation Thinsolate.

Figure 5:
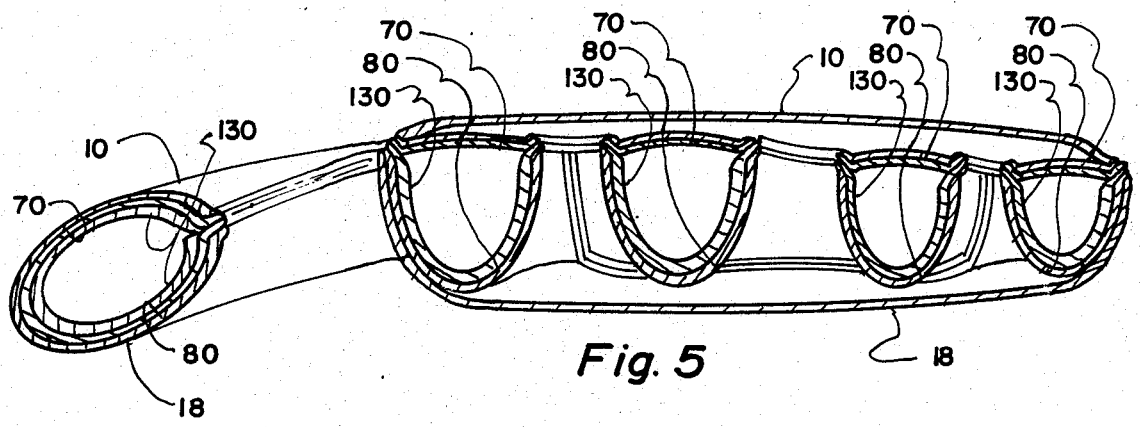
FIG. 5 is a cross-sectional view of the glove of FIG. 2 taken along sectional line 5.

A fabric palm liner panel 80 is also provided. Palm liner panel 80 is dimensioned and shaped similarly to palm panel 18. As shown in FIG. 5, panels 70 and 80 are joined together along their perimeters by stitching or other means known in the art, e.g. adhesives. The conjunction of panels 70 and 80 defines a generally hand-shaped structure 81 having an open end 82 adapted to receive the hand of the wearer into the interior chamber 84 defined within the structure 81, and having an individual finger cover 83 for each finger of the wearer.

Palm liner panel 80 may be fabricated from a closed-cell foam material, e.g. neoprene or a nutrile vinyl blend, having a very low thermal conductivity. Owing to the breathability of the fabric utilized in the back liner panel 70, the material composing the palm liner panel 80 may be substantially, if not completely, impermeable to air or moisture. This permits a choice of materials with extremeley low thermal conductivity.

In a preferred embodiment, the palm panel 80 is fabricated from a polyethylene foam sold commercially under the trademark Ensolite.

In a construction which parallels the skin construction utilizing a side panel 20 interposed between the back panel 10 and palm panel 18, a corresponding liner side panel 86 may be interposed between the back liner panel 70 and palm liner panel 80. This side liner panel 86 is a generally elongate strip having side edges 90 and 92.

Figure 3:
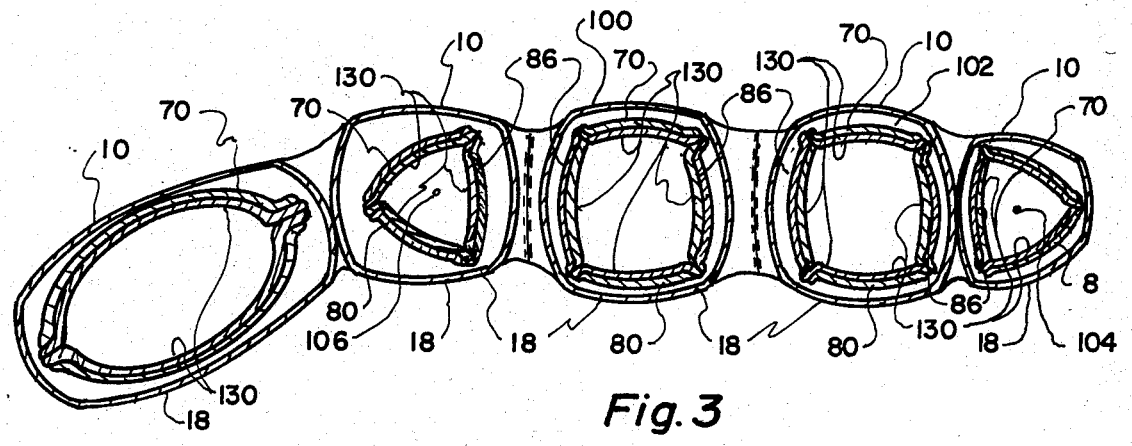
FIG. 3 is a cross-sectional view of the glove illustrated in FIG,. 1 along sectional line 3.
Figure 4:
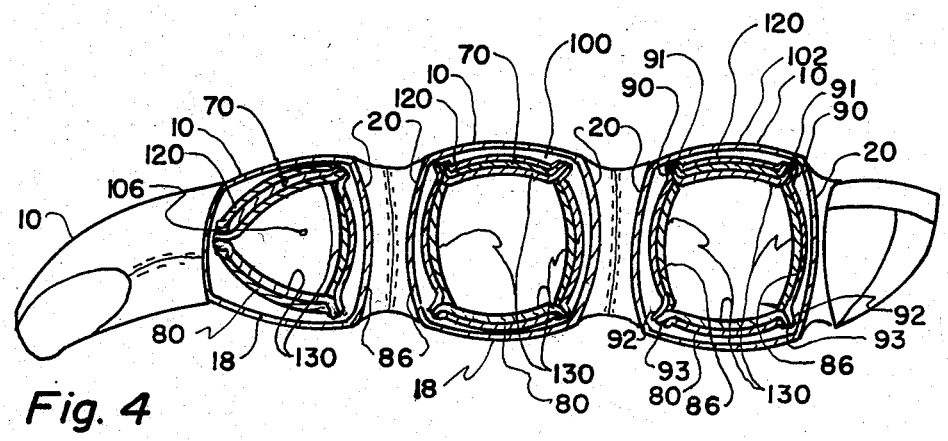
FIG. 4 is a cross-sectional view of the glove of FIG. 1 along section line 4.

Edge 90 is joined to edge 91 of the back liner panel over substantially the total length of edge 91. A similar attachment occurs between edge 92 and edge 93 of the palm liner panel. The use of a side liner panel 86 yields a construction whereing the finger covers are essentially quadrilateral in cross-section, as shown in finger covers 100 and 102 of FIGS. 3 and 4. The liners shown in cross-section in FIGS. 3 and 4 include a side liner panel 86 which extends only along the edges 91 and 92 of liner panels 70 and 80 between points 104 and 106, i.e. between the portion of the glove running from the covering for the apex of the wearer's little finger to the covering for the index finger. In the shown construction, i.e. FIGS. 1, 3 and 4, edges 91 and 92 of panels 70 and 80 are joined directly to each other on the portions thereof running from point 104 to distal point 110 and point 106 to distal point 112.

Side liner panel 86 may be fabricated from either of the materials used in the fabrication of liner panels 70 and 80. Alternately, liner side panel 86 may be fabricated from nylon tricot or olefin polyethylene.

In a preferred embodiment, fingertip panels 120 are positioned and secured on the back side 121 of finger covers 83. Typically, these covers are fabricated from the same material utilized in constructing the palm liner panel, i.e. a closed-cell foam composition.

As may be realized, this invention contemplates a liner assembly which includes approximately 50% of its assembly being fabricated of an extremely low thermal conductivity material, while the remaining approximately 50% of the construction utilizes a material with low thermal conductivity while jointly incorporating a significant permeability to air and moisture. The materials composing the various liner panels may be substituted one for the other, provided the material having the properties of air and moisture permeability are retained in at least approximately 30% of the liner's fabric panels. For example, a glove 9 according to this invention may include a back liner panel 70 being fabricated from closed-cell foam and having a palm liner panel 80 fabricated from olefin polypropylene. Furthermore, the glove may include a liner side panel 86 composed of closed-cell foam.

A secondary liner 130 may also be used in glove 9. This secondary liner is typically positioned within the interior of liner structure 81. Secondary liner 130 is configurated to receive and completely encase the hand of the wearer. In a preferred embodiment, this secondary liner 130 is composed of a bonded to the inner surface of the liner assembly 81 nylon tricot or olefin polyethylene coating which is this secondary liner is fabricated from a material which possesses good moisture absorption characteristics and is furthermore permeable to liquid as well as moisture and air.

In use, the glove 9 permits a construction which includes a high degree of flexibility over the palm region of the wearer's hand, thereby allowing the wearer considerable maneuverability and finger movement. Furthermore, the palm panel 18 is wind-resistant for warmth. The back panel 10 is impermeable to wind and moisture and thereby effectively insulates the wearer's hand from convective heat transfer. The glove's lining assembly provides a significantly high "R" factor while simultaneously permitting any moisture driven from the wearer's hand by sweating to be absorbed by the secondary lining and thereafter be transmitted through the olefin polypropylene liner to be eventually discharged through the coated nylon back panel of the glove's skin.

It should be understood that the embodiments herein described are merely illustrative of the principals of the invention. Reference herein to the details of the illustrated embodiments is not intended to limit the scope of the claims, which themselves recite those features regarded as essential to the invention.

We claim:

1. An insulated ski glove having an open end to receive a hand of the wearer, said glove comprising:

a hand-encasing skin member to surround the hand, said hand-encasing skin member having:

a first outer member fabricated from a fabric permeable to water vapor and impermeable to liquid water, and a second outer member securely joined to said first outer member, said second outer member being fabricated from a flexible wind-resistant fabric;

a first insulation layer having:

a first moisture permeable liner positioned within said hand-encasing skin member and adjacent said first outer member, and a second liner positioned within said hand-encasing skin member and adjacent said second outer member, said second liner being securely joined to said first liner, said second liner being fabricated from an air-impermeable closed-cell foam; and a second insulation layer positioned within said first insulation layer, said second insulation layer comprising a third liner being adapted to receive and completely encase the hand of the wearer, said third liner being fabricated from a moisture-permeable textile.

2. The ski glove of claim 1 wherein said hand-encasing skin member, first insulation layer and second insulation layer are adapted with an individualized cover for each finger of the wearer's hand.

3. The ski glove of claim 1 wherein the open end of said ski glove is fitted with a cuff member.

4. The ski glove of claim 3 wherein a zipper having a sliding tab is secured within said first outer member, proximate the open end of said ski glove, wherein a displacement of said tab in a first direction operates to lessen the perimeter of said open end of said ski glove, while a displacement of said tab in a second direction operates to enlarge the perimeter of said open end of said ski glove.

5. The ski glove of claim 2 wherein at least one of the individualized finger covers is comprised of at least three fabric panels.

6. The ski glove of claim 5 wherein at least two of said panels are fabricated from said essentially air-impermeable, closed-cellfoam.

7. The ski glove of claim 1 wherein said second insulation layer is fabricated from nylon tricot.

8. The ski glove of claim 1 wherein said first liner is fabricated from closed-cell nutrile blend foam.

9. The ski glove of claim 1 wherein said first outer member is fabricated from a microporous nylon having a urethane coating.

10. The ski glove of claim 1 wherein said second outer member is fabricated from leather.

11. An insulated ski glove having an open end to receive a hand of the wearer, said glove further comprising:

a hand-encasing member to surround the hand, said hand-encasing member having:

a first outer member fabricated from a microporous nylon having a urethane coating, said member having the property of being permeable to water vapor but impermeable to liquid water, and a second outer member securely joined to said first outer member, said conjunction of said first and second outer members defining an integrated hand-encasing skin member, said second outer member being fabricated from leather;

a first insulation layer having:

a first moisture permeable liner positioned within said skin member and located adjacent said first outer member, and a second liner positioned within said skin member and adjacent said second outer member, said second liner being securely joined to said first liner, said second liner being fabricated from an essentially air-impermeable closed-cell vinyl foam; and a second insulation layer positioned within said first insulation layer, said second insulation layer comprising a third liner being adapted to receive and completely encase the hand of the wearer and being fabricated from a moisture-permeable nylon tricot fabric.

12. An insulated ski glove for encasing the hand of a wearer comprising:

an outer shell formed to surround the hand, said outer shell having a top portion formed of fabric permeable to water vapor and impermeable to liquid water; and an inner lining formed to surround the hand and to fit within said outer shell, said inner lining being formed of fabric having a low thermal conductivity, a portion of said inner lining being permeable to liquid water and moisture.

13. The insulated ski glove according to claim 12 wherein said outer shell includes a bottom portion formed of a flexible, wind-resistant fabric.

14. The insulated ski glove according to claim 12 wherein said inner lining has a portion thereof fabricated from an air-impermeable, closed-cell foam.

15. The insulated ski glove according to claim 14 wherein said outer shell includes a bottom portion formed of a flexible, wind-resistant fabric.

* * * * *